US010945317B1

(12) United States Patent
Hsu

(10) Patent No.: US 10,945,317 B1
(45) Date of Patent: Mar. 9, 2021

(54) FIVE COLOR TEMPERATURE SWITCHING CIRCUIT

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co,. Ltd. China, Guang-Dong (CN)

( * ) Notice: Subject to any disclaimer, the term of this patent is extended or adjusted under 35 U.S.C. 154(b) by 0 days.

(21) Appl. No.: 16/747,018

(22) Filed: Jan. 20, 2020

(51) Int. Cl.
*H05B 45/30* (2020.01)

(52) U.S. Cl.
CPC ..... *H05B 45/30* (2020.01)

(58) Field of Classification Search
None
See application file for complete search history.

(56) References Cited

U.S. PATENT DOCUMENTS 9,691,236 B1 * 6/2017 Abraham ..... H05B 47/10
2012/0262080 A1 * 10/2012 Watanabe ..... H05B 45/10 315/210
2018/0098393 A1 * 4/2018 Matsumoto ..... B60Q 1/1423

* cited by examiner

*Primary Examiner* — Crystal L Hammond
(74) *Attorney, Agent, or Firm* — Karin L. Williams; Mayer & Williams PC

(57) ABSTRACT

A five color temperature switching circuit includes a power supply, an LED driver, a first LED light, a second LED light, a third LED light, a first diode, a second diode, a third diode, a fourth diode, and a switch. The switch has twelve connecting ports. The switch has five regulating stages corresponding to the twelve connecting ports. Thus, the five color temperature switching circuit is provided with three LED lights with three different color temperature values, four diodes, and the switch, such that the lamp provides an illuminating function with five color temperature values.

3 Claims, 2 Drawing Sheets

FIVE COLOR TEMPERATURE SWITCHING CIRCUIT

BACKGROUND OF THE INVENTION

1. Field of the Invention

The present invention relates to an electric circuit and, more particularly, to a five color temperature switching circuit.

2. Description of the Related Art

A conventional lamp has a fixed color temperature that is fixed and cannot be adjusted according to the practical requirement, thereby limiting the versatility of the conventional lamp. A conventional LED circuit can be used to regulate its color temperature. However, the conventional LED circuit has a complicated construction, thereby increasing the cost of assembly, production and fabrication. In addition, the conventional LED circuit has a poor color temperature changing effect, and cannot satisfy the requirement of the consumers. A conventional color temperature switching lamp comprises two lighting balls with two different color temperatures which are mixed. However, the color temperature switching function is not regulated exactly. In addition, the conventional color temperature switching lamp has a greater cost of fabrication. Further, the conventional color temperature switching lamp cannot satisfy a market requirement for multiple different color temperatures.

BRIEF SUMMARY OF THE INVENTION

The primary objective of the present invention is to provide a five color temperature switching circuit that is used for a lamp to provide five different color temperature values.

In accordance with the present invention, there is provided a five color temperature switching circuit comprising a power supply, an LED driver, a first LED light, a second LED light, a third LED light, a first diode, a second diode, a third diode, a fourth diode, and a switch. The switch has twelve connecting ports. The twelve connecting ports of the switch includes a first connecting port, a second connecting port, a third connecting port, a fourth connecting port, a fifth connecting port, a sixth connecting port, a seventh connecting port, an eighth connecting port, a ninth connecting port, a tenth connecting port, an eleventh connecting port, and a twelfth connecting port. The first LED light has an output terminal electrically connected with the first connecting port. The first diode has an input terminal electrically connected with the first connecting port. The first diode has an output terminal electrically connected with the ninth connecting port. The second diode has an input terminal electrically connected with the fourth connecting port. The second diode has an output terminal electrically connected with the eighth connecting port. The output terminal of the second diode is electrically connected with the output terminal of the first diode. The tenth connecting port is electrically connected with the second connecting port and the fifth connecting port. The LED driver has an input terminal electrically connected with the power supply. The LED driver has an output terminal having a positive pole electrically connected with the first LED light, the second LED light, and the third LED light. The output terminal of the LED driver has a negative pole electrically connected with the second connecting port. The second LED light has an output terminal electrically connected with the third connecting port. The third diode has an input terminal electrically connected with the third connecting port. The third diode has an output terminal electrically connected with the fourth connecting port. The fourth diode has an input terminal electrically connected with the output terminal of the third LED light and the sixth connecting port. The fourth diode has an output terminal electrically connected with the output terminal of the third diode.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
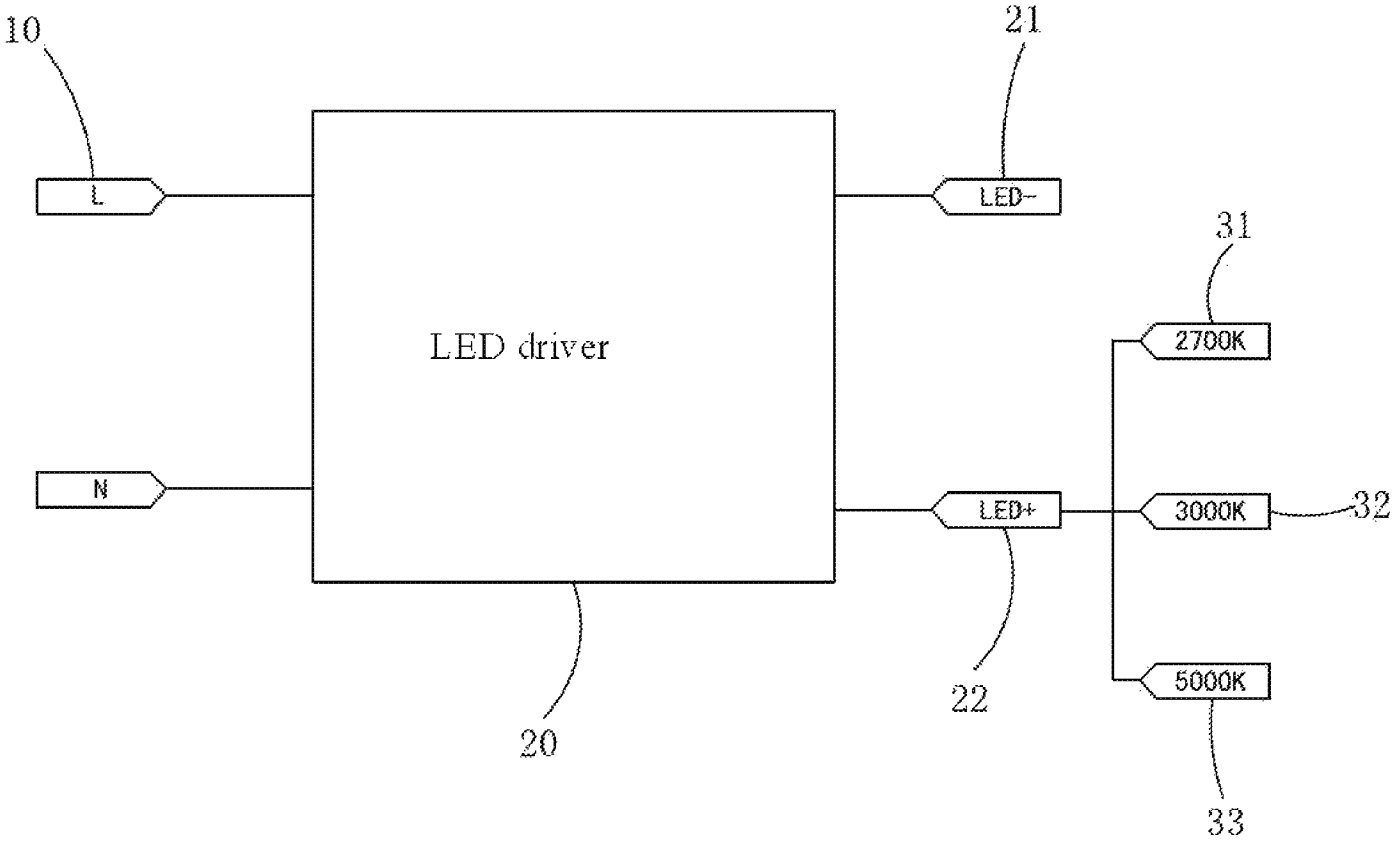
FIG. 1 is a schematic diagram showing connection of a five color temperature switching circuit in accordance with the preferred embodiment of the present invention.
Figure 2:
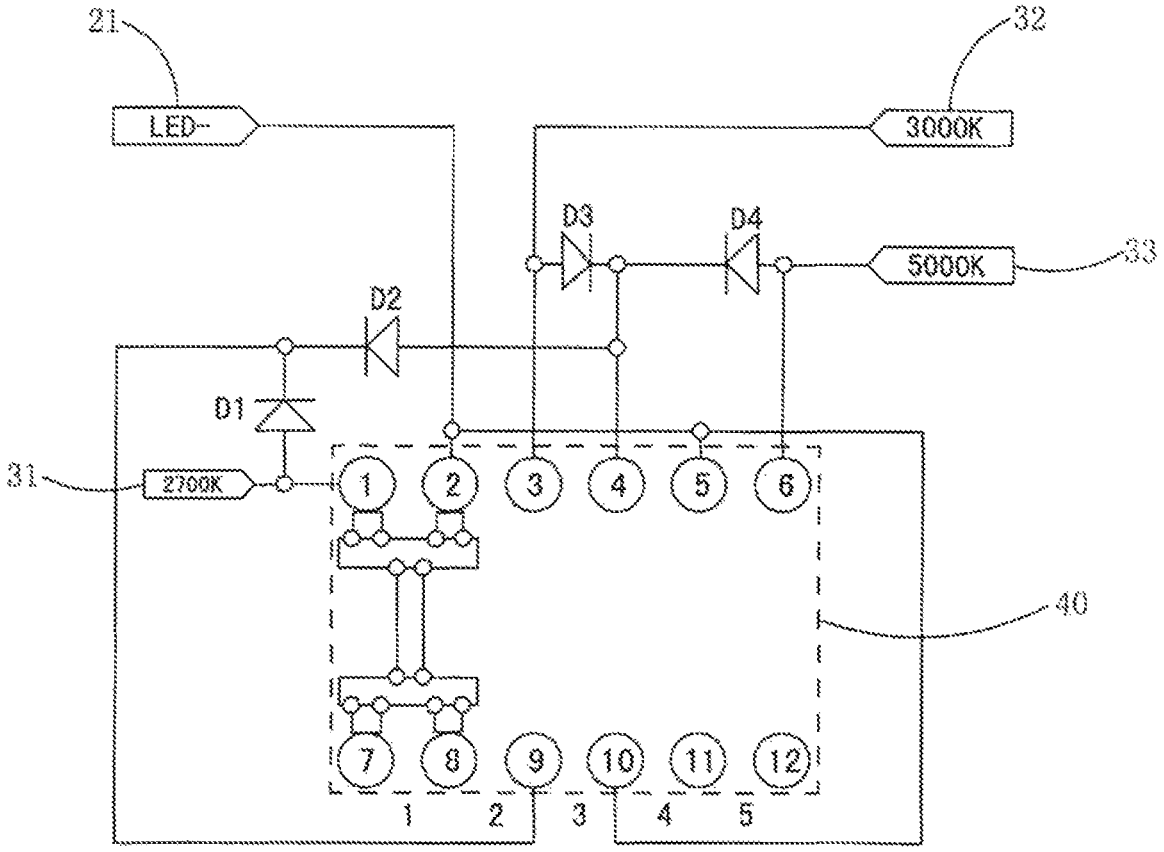
FIG. 2 is another schematic diagram showing connection of the five color temperature switching circuit in accordance with the preferred embodiment of the present invention.

Referring to FIGS. 1 and 2, a five color temperature switching circuit in accordance with the preferred embodiment of the present invention comprises a power supply 10, an LED driver (or actuator) 20, a first LED light 31, a second LED light 32, a third LED light 33, a first diode D1, a second diode D2, a third diode D3, a fourth diode D4, and a switch 40.

The switch 40 is a stage (or gear) selector switch or pull gear switch and has multiple stages (or gears). The switch 40 has twelve connecting ports. The twelve connecting ports of the switch 40 includes a first connecting port 1, a second connecting port 2, a third connecting port 3, a fourth connecting port 4, a fifth connecting port 5, a sixth connecting port 6, a seventh connecting port 7, an eighth connecting port 8, a ninth connecting port 9, a tenth connecting port 10, an eleventh connecting port 11, and a twelfth connecting port 12.

The first LED light 31 has an output terminal electrically connected with the first connecting port 1. The first diode D1 has an input terminal electrically connected with the first connecting port 1. The first diode D1 has an output terminal electrically connected with the ninth connecting port 9. The second diode D2 has an input terminal electrically connected with the fourth connecting port 4. The second diode D2 has an output terminal electrically connected with the eighth connecting port 8. The output terminal of the second diode D2 is electrically connected with the output terminal of the first diode D1.

The tenth connecting port 10 is electrically connected with the second connecting port 2 and the fifth connecting port 5. The LED driver 20 has an input terminal electrically connected with the power supply 10. The LED driver 20 has an output terminal having a positive pole 22 electrically connected with the first LED light 31, the second LED light 32, and the third LED light 33. The output terminal of the LED driver 20 has a negative pole 21 electrically connected with the second connecting port 2. The second LED light 32 has an output terminal electrically connected with the third connecting port 3. The third diode D3 has an input terminal electrically connected with the output terminal of the second LED light 32 and the third connecting port 3. The third diode D3 has an output terminal electrically connected with the fourth connecting port 4. The fourth diode D4 has an input terminal electrically connected with the output terminal of the third LED light 33 and the sixth connecting port 6. The fourth diode D4 has an output terminal electrically connected with the output terminal of the third diode D3.

In the preferred embodiment of the present invention, the first connecting port 1, the second connecting port 2, the third connecting port 3, the fourth connecting port 4, the fifth connecting port 5, and the sixth connecting port 6 are arranged at a first row (or array), and the seventh connecting port 7, the eighth connecting port 8, the ninth connecting port 9, the tenth connecting port 10, the eleventh connecting port 11, and the twelfth connecting port 12 are arranged at a second row (or array). The switch 40 has five regulating stages corresponding to the twelve connecting ports. Each of the five regulating stages has a first end connected with two adjacent connecting ports arranged at the first row, and a second end connected with two adjacent connecting ports arranged at the second row.

In practice, the five regulating stages include a first regulating stage having a first end connected with the first connecting port 1 and the second connecting port 2, and a second end connected with the seventh connecting port 7 and the eighth connecting port 8, a second regulating stage having a first end connected with the second connecting port 2 and the third connecting port 3, and a second end connected with the eighth connecting port 8 and the ninth connecting port 9, a third regulating stage having a first end connected with the third connecting port 3 and the fourth connecting port 4, and a second end connected with the ninth connecting port 9 and the tenth connecting port 10, a fourth regulating stage having a first end connected with the fourth connecting port 4 and the fifth connecting port 5, and a second end connected with the tenth connecting port 10 and the eleventh connecting port 11, and a fifth regulating stage having a first end connected with the fifth connecting port 5 and the sixth connecting port 6, and a second end connected with the eleventh connecting port 11 and the twelfth connecting port 12.

In the preferred embodiment of the present invention, the first LED light 31 has a color temperature of 2700° K, the second LED light 32 has a color temperature of 3000° K, and the third LED light 33 has a color temperature of 5000° K.

Thus, the five regulating stages of the switch 40 are changed to adjust and regulate the working conditions of the first LED light 31, the second LED light 32, and the third LED light 33, such that the five color temperature switching circuit provides an illuminating function with five color temperature values, and the user freely adjust the five color temperature values according to practical requirement.

In operation, referring to FIG. 2 with reference to FIG. 1, when the switch 40 is switched to the first regulating stage, the electric current of the LED driver 20 passes through the first diode D1, such that the first LED light 31 is turned on, while the second LED light 32 and the third LED light 33 are turned off. At this time, the lamp has a color temperature of 2700° K.

Alternatively, when the switch 40 is switched to the second regulating stage, the second LED light 32 is turned on, while the first LED light 31 and the third LED light 33 are turned off. At this time, the lamp has a color temperature of 3000° K.

Alternatively, when the switch 40 is switched to the third regulating stage, the electric current of the LED driver 20 passes through the first diode D1, the second diode D2, and the fourth diode D4, such that the first LED light 31, the second LED light 32, and the third LED light 33 are turned on. At this time, the lamp has a color temperature of 3500° K.

Alternatively, when the switch 40 is switched to the fourth regulating stage, the electric current of the LED driver 20 passes through the third diode D3 and the fourth diode D4, such that the second LED light 32 and the third LED light 33 are turned on, while the first LED light 31 is turned off. At this time, the lamp has a color temperature of 4000° K.

Alternatively, when the switch 40 is switched to the fifth regulating stage, the second LED light 32 is turned on, while the first LED light 31 and the third LED light 33 are turned off. At this time, the lamp has a color temperature of 5000° K.

Accordingly, the five color temperature switching circuit is provided with three LED lights with three different color temperature values, four diodes, and the switch 40, such that the lamp provides an illuminating function with five color temperature values, thereby facilitating the user adjusting the five color temperature values according to practical requirement. In addition, the light is mixed exactly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A five color temperature switching circuit comprising:

a power supply, an LED driver, a first LED light, a second LED light, a third LED light, a first diode, a second diode, a third diode, a fourth diode, and a switch;

wherein:

the switch has twelve connecting ports;

the twelve connecting ports of the switch includes a first connecting port, a second connecting port, a third connecting port, a fourth connecting port, a fifth connecting port, a sixth connecting port, a seventh connecting port, an eighth connecting port, a ninth connecting port, a tenth connecting port, an eleventh connecting port, and a twelfth connecting port;

the first LED light has an output terminal electrically connected with the first connecting port;

the first diode has an input terminal electrically connected with the first connecting port;

the first diode has an output terminal electrically connected with the ninth connecting port;

the second diode has an input terminal electrically connected with the fourth connecting port;

the second diode has an output terminal electrically connected with the eighth connecting port;

the output terminal of the second diode is electrically connected with the output terminal of the first diode;

the tenth connecting port is electrically connected with the second connecting port and the fifth connecting port;

the LED driver has an input terminal electrically connected with the power supply;

the LED driver has an output terminal having a positive pole electrically connected with the first LED light, the second LED light, and the third LED light;

the output terminal of the LED driver has a negative pole electrically connected with the second connecting port;

the second LED light has an output terminal electrically connected with the third connecting port;

the third diode has an input terminal electrically connected with the third connecting port;

the third diode has an output terminal electrically connected with the fourth connecting port;

the fourth diode has an input terminal electrically connected with the output terminal of the third LED light and the sixth connecting port; and the fourth diode has an output terminal electrically connected with the output terminal of the third diode.

2. The five color temperature switching circuit of claim 1, wherein:

the first connecting port, the second connecting port, the third connecting port, the fourth connecting port, the fifth connecting port, and the sixth connecting port are arranged at a first row, and the seventh connecting port, the eighth connecting port, the ninth connecting port, the tenth connecting port, the eleventh connecting port, and the twelfth connecting port are arranged at a second row;

the switch has five regulating stages corresponding to the twelve connecting ports;

each of the five regulating stages has a first end connected with two adjacent connecting ports arranged at the first row, and a second end connected with two adjacent connecting ports arranged at the second row;

the five regulating stages include a first regulating stage having a first end connected with the first connecting port and the second connecting port, and a second end connected with the seventh connecting port and the eighth connecting port.

3. The five color temperature switching circuit of claim 1, wherein the first LED light has a color temperature of 2700° K, the second LED light has a color temperature of 3000° K, and the third LED light has a color temperature of 5000° K.

* * * * *